US006301800B1

(12) United States Patent
Standley

(10) Patent No.: US 6,301,800 B1
(45) Date of Patent: Oct. 16, 2001

(54) METHOD OF USE FOR INVERTED BONNET HAIR DRYER

(76) Inventor: Laurel Standley, 7191 W. Dry Creek Rd., Healdburg, CA (US) 95448

( * ) Notice: Subject to any disclaimer, the term of this patent is extended or adjusted under 35 U.S.C. 154(b) by 0 days.

(21) Appl. No.: 09/772,690

(22) Filed: Jan. 30, 2001

Related U.S. Application Data

(62) Division of application No. 09/664,290, filed on Sep. 18, 2000, now Pat. No. 6,266,893.

(51) Int. Cl.[7] ..... A45D 20/00
(52) U.S. Cl. ..... 34/283; 34/418
(58) Field of Search ..... 34/96, 97, 98, 34/99, 283, 418, 427; 392/380, 381, 382, 383, 384, 385

(56) References Cited

U.S. PATENT DOCUMENTS

| | | | | |
|---|---|---|---|---|
| 2,022,237 | * | 11/1935 | Grant | 34/98 |
| 2,042,592 | * | 6/1936 | Ducart | 34/99 |
| 2,051,833 | * | 8/1936 | Ehrlich | 248/371 |
| 2,073,401 | * | 3/1937 | Crowley | 34/99 |
| 2,632,960 | * | 3/1953 | Bucknell et al. | 34/99 |
| 2,663,090 | * | 12/1953 | Flaxman | 34/99 |
| 3,782,002 | * | 1/1974 | Morane | 34/99 |
| 4,692,594 | * | 9/1987 | Martin | 219/373 |
| 5,313,716 | * | 5/1994 | Wolfe | 34/90 |
| 5,640,781 | * | 6/1997 | Carson | 34/97 |
| 5,671,321 | * | 9/1997 | Bagnuolo | 392/385 |

* cited by examiner

*Primary Examiner*—Pamela Wilson
(74) *Attorney, Agent, or Firm*—Jack Lo

(57) ABSTRACT

The present inverted bonnet hair dryer is comprised of a bowl with a closed end and an open end. The bowl is pivotally supported on a stand and is rotatable to a position with its open end facing upward. The bowl is comprised of a hemispherical concave inner wall which is generally spaced from an outer wall. The perimeter of the inner wall is connected to the outer wall to define a space between the walls. A hollow tube is attached to the outer wall. An aperture at an outer end of the tube is in communication with the space within the bowl. The aperture is adapted to receive the head of a conventional hand-held electric blow dryer. When the open end is facing upward, the bowl is adapted to be positioned under the head of a person. The head is inverted to hang the hair under the head. The inner wall of the bowl is adapted to evenly support the hair. When the blow dryer is activated, hot air is forced into the space between the walls and released through holes on the inner wall to dry the hair. Greater volume in the hair is produced by drying it in a hanging position under an inverted head. In a second embodiment, an electric blow dryer is integrally attached to the bowl.

2 Claims, 2 Drawing Sheets

METHOD OF USE FOR INVERTED BONNET HAIR DRYER

CROSS REFERENCE TO RELATED APPLICATIONS

This is a division of application Ser. No. 09/664,290 which was filed on Sep. 18, 2000 now U.S. Pat. No. 6,266,893.

BACKGROUND OF THE INVENTION

1. Field of the Invention

This invention relates generally to hair dryers.

2. Prior Art

One of the most desirable attributes of all hair styles is volume, but it is not easy to produce. Since wet hair is heavy, it tends to hang straight down from the top of the scalp when the head is upright. If the hair is dried in such a position, it will be flat and lifeless. To produce volume, the hair must be lifted perpendicularly away from the scalp while it is drying. The conventional technique for creating volume is to dry the hair with a hand-held blow dryer in one-hand, and scrunch the hair with the other hand. Because only a small tuff of hair can scrunched at a time and only temporarily, while the rest of the hair is hanging flat against the scalp, little volume can be produced with this technique. It is also slow and tiring since typical drying time is about 15 minutes.

Bonnet hair dryers are available for drying the entire head of hair simultaneously and hands-free. A typical bonnet hair dryer is comprised of a bowl hinged to a stand. The bowl is positioned with its open end facing down and over the head of a person. An electric blow dryer is attached to the closed end of the bowl for drying the hair. However, since the hair is dried while it is hanging straight down from the scalp, the hair is dried flat and lifeless.

Other types of bonnet hair dryers are known among the prior art. Some of them are comprised of bowls with an open end positioned on the side for receiving a reclining head. Because the hair at the front half of the head is still hung flat against the scalp, such bonnet dryers still dry the hair without any volume. None of the prior art bonnet hair dryers can be positioned with the open end of the bowl f acing upward.

OBJECTIVES OF THE INVENTION

Accordingly, the objectives of the present inverted bonnet hair dryer are:

to dry hair with greater volume;

to dry hair hands-free;

to dry hair more quickly; and to be adjustable to different positions.

Further objectives of the present invention will become apparent from a consideration of the drawings and ensuing description.

BRIEF SUMMARY OF THE INVENTION

The present inverted bonnet hair dryer is comprised of a bowl with a closed end and an open end. The bowl is pivotally supported on a stand and is rotatable to a position with its open end facing upward. The bowl is comprised of a hemispherical concave inner wall which is generally spaced from an outer wall. The perimeter of the inner wall is connected to the outer wall to define a space between the walls. A hollow tube is attached to the outer wall. An aperture at an outer end of the tube is in communication with the space within the bowl. The aperture is adapted to receive the head of a conventional hand-held electric blow dryer. When the open end is facing upward, the bowl is adapted to be positioned under the head of a person. The head is inverted to hang the hair under the head. The inner wall of the bowl is adapted to evenly support the hair. When the blow dryer is activated, hot air is forced into the space between the walls and released through holes on the inner wall to dry the hair. Greater volume in the hair is produced by drying it in a hanging position under an inverted head. In a second embodiment, an electric blow dryer is integrally attached to the bowl.

DRAWING REFERENCE NUMERALS

10. Bowl
11. Closed End
12. Open End
13. U-Shaped Frame
14. Stand
15. Inner Wall
16. Outer Wall
17. Space
18. Holes
19. Tube
20. Aperture
21. Funnel
22. Retainers
23. Seal
24. Head
25. Blow Dryer
26. Handle
27. Blow Dryer

DETAILED DESCRIPTION OF THE INVENTION

Figure 1:
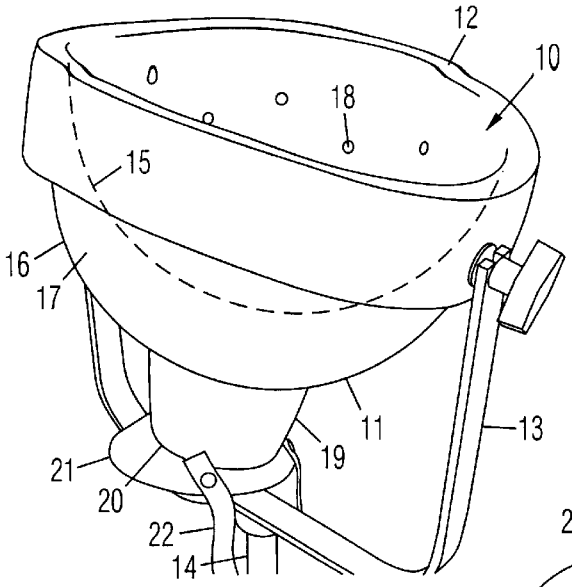
FIG. 1 is a perspective view of the present inverted bonnet hair dryer.

FIG. 1:

A first embodiment of the present inverted bonnet hair dryer is shown in a perspective view in FIG. 1. It is comprised of a bowl 10 with a closed end 11 and an open end 12. Bowl 10 is pivotally supported in a U-shaped frame 13 which is part of a stand 14. Bowl 10 is preferably rotatable 360 degrees about the horizontal axis in frame 13, and frame 13 is rotatable 360 degrees about the vertical axis on stand 14. Alternatively, the stand may be eliminated, and bowl 10 may be provided with feet adjacent closed end 11 for standing on a table or counter.

Bowl 10 is comprised of a hemispherical concave inner wall 15 which is generally spaced from an outer wall 16. The perimeter of inner wall 15 is connected to outer wall 16 to define a space 17 between the walls. Holes 18 are arranged throughout the surface of inner wall 15.

A hollow tube 19 is attached to outer wall 16. An aperture 20 at an outer end of tube 19 is in communication with space 17 within bowl 10. A funnel 21 is attached around aperture

20, and retainers 22 are attached to funnel 21. Retainers 22 are preferably hook-and-loop straps, but other types of retainers may be used. Also, retainers 22 may be attached directly to outer wall 16 of bowl 10. Tube 19 may be eliminated and aperture 20 may be provided directly on outer wall 16.

Figure 2:
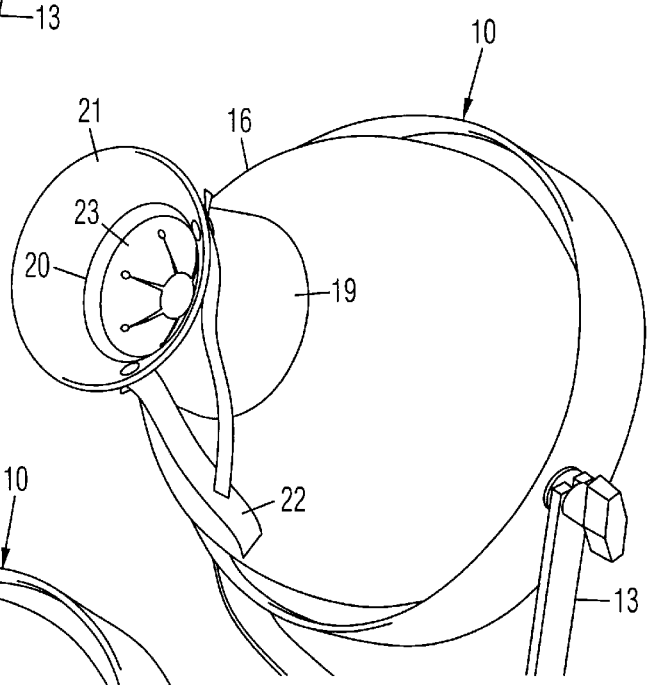
FIG. 2 is a perspective view thereof rotated to show the aperture for receiving a conventional hand-held blow dryer.

FIG. 2:

In FIG. 2, bowl 10 is rotated within frame 13 to move aperture 20 to more accessible position. An annular elastic seal 23 is positioned across aperture 20.

Figure 3:
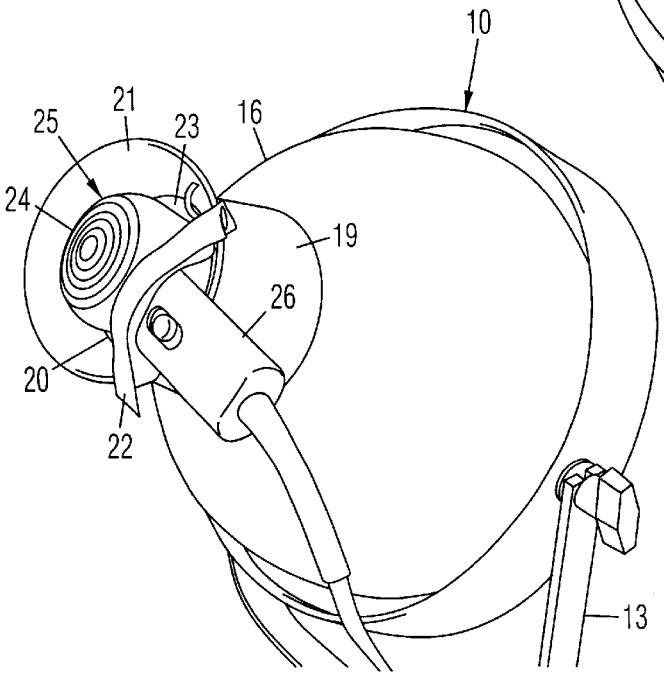
FIG. 3 is a perspective view thereof with a conventional hand-held blow dryer attached.

FIG. 3:

In FIG. 3, a head 24 of a conventional hand-held blow dryer 25 is inserted into aperture 20. The insertion of blow dryer 25 is aided by funnel 21. Blow dryer 25 is secured in position by retainers 22 which are strapped around a handle 26 on blow dryer 25. The gap between aperture 20 and head 24 of blow dryer 25 is generally closed by seal 23 to prevent air leaks.

Figure 4:
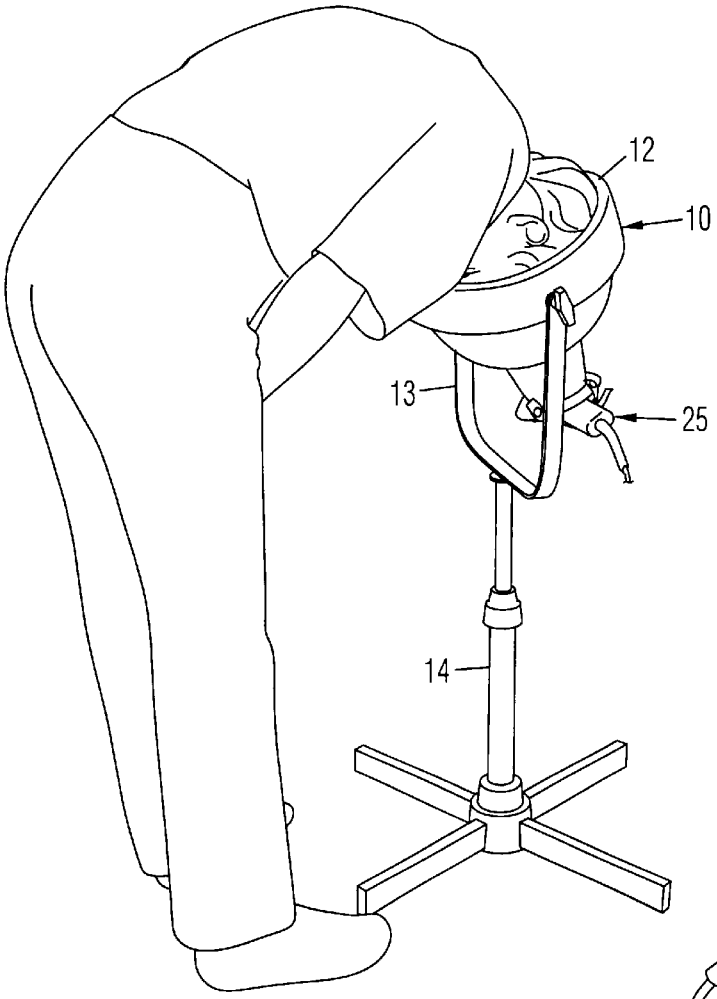
FIG. 4 is a perspective view thereof in use.

FIG. 4:

In FIG. 4, the bonnet hair dryer is shown in use. Bowl 10 is rotated to a position in which open end 12 is facing substantially upward. Bowl 10 is adapted to be positioned under the head of a person, who can be standing or sitting. The head is inverted to hang the hair under the head. The hemispherical concave inner wall of bowl 10 is adapted to evenly support all of the hair. When blow dryer 25 is activated, hot air is forced into the space between the walls and released through the holes on the inner wall to dry all the hair simultaneously and hands-free. Much greater volume in the hair is produced by drying it in a hanging position under an inverted head. Drying time is also substantially improved over that of conventional bonnet hair dryers, because hair hanging from an inverted head is looser and has more space between them for air circulation.

Figure 5:
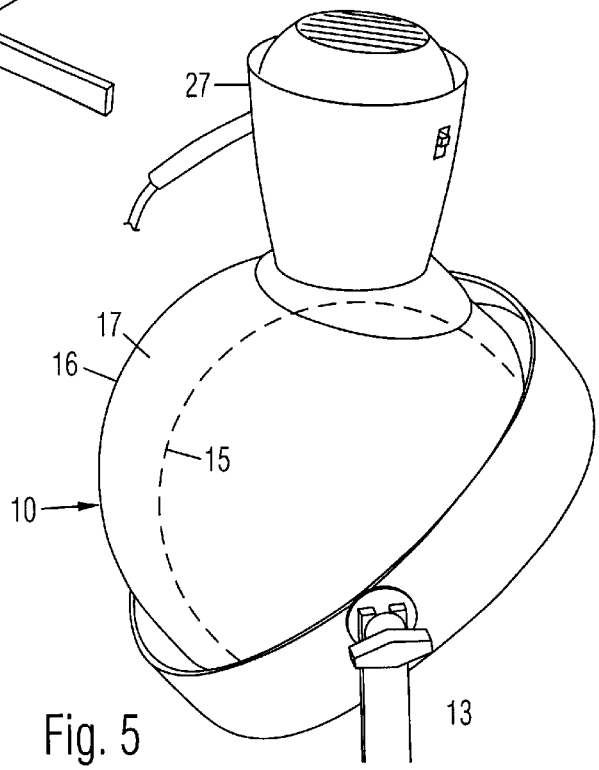
FIG. 5 is a perspective view of an alternative embodiment thereof.

FIG. 5:

In a second embodiment shown in FIG. 5, an integral electric blow dryer 27 is attached to bowl 10 for directing hot air into space 17 between inner wall 15 and outer wall 16, and out the holes on the inner wall.

SUMMARY AND SCOPE

Accordingly, the present inverted bonnet hair dryer dries hair with greater volume. It dries hair hands-free. It dries hair more quickly. It is also adjustable to different positions.

Although the above description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. Therefore, the scope of the invention should be determined by the appended claims and their legal equivalents, not by the examples given.

I claim:

1. A method for drying hair, comprising the steps of:

providing a hair dryer comprised of a concave bowl;

positioning an open end of said bowl to face substantially upward;

fully inverting a person's head to hang wet hair from said head;

positioning said wet hair in said bowl; and blowing hot air at said wet hair from an interior of said bowl.

2. A method for drying hair, comprising the steps of:

providing a hair dryer comprised of a concave bowl;

providing apertures on an inner wall of said bowl;

positioning an open end of said bowl to face substantially upward;

fully inverting a person's head to hang wet hair from said head;

positioning said wet hair in said bowl; and blowing hot air at said wet hair from said apertures on said inner wall of said bowl.

* * * * *